United States Patent [19]

Cochran et al.

[11] 4,143,783

[45] Mar. 13, 1979

[54] REVERSE LINKAGE LOADER BUCKET ARM WITH ENCLOSED CYLINDER

[75] Inventors: Gary L. Cochran; Charles D. Wilson, both of Burlington, Iowa

[73] Assignee: J. I. Case Company, Racine, Wis.

[21] Appl. No.: 860,150

[22] Filed: Dec. 14, 1977

[51] Int. Cl.[2] ..... E02F 3/74

[52] U.S. Cl. ..... 414/715; 414/727

[58] Field of Search ..... 214/140, 145 R, 149, 214/778

[56] References Cited

U.S. PATENT DOCUMENTS

| | | | |
|---|---|---|---|
| 2,940,623 | 6/1960 | Shook | 214/778 X |
| 3,047,172 | 7/1962 | Ulinski | 214/778 |
| 3,251,490 | 5/1966 | Guinot | 214/138 R |
| 3,532,234 | 10/1970 | Grant | 214/778 X |

*Primary Examiner*—L. J. Paperner

*Attorney, Agent, or Firm*—Arthur J. Hansmann

[57] ABSTRACT

A reverse linkage loader bucket arm with an enclosed cylinder assembly and wherein a loader bucket is pivotally mounted on the arm and the cylinder assembly induces the pivotal action. The lift or support arm for the bucket is hollow along its longitudinal axis and the cylinder assembly is mounted within the hollow arm and projects through an open end thereof to pivotally connect with the bucket and the point of pivotal connection is to the side of the pivotal connection of the arm in the bucket away from the bucket. The cylinder fluid lines are also disposed within the hollow boom or lift arm, and thus the cylinder assembly and the lines or hoses are enclosed and thereby protected and arranged for reverse linkage connection relative to the arm and the bucket.

4 Claims, 4 Drawing Figures

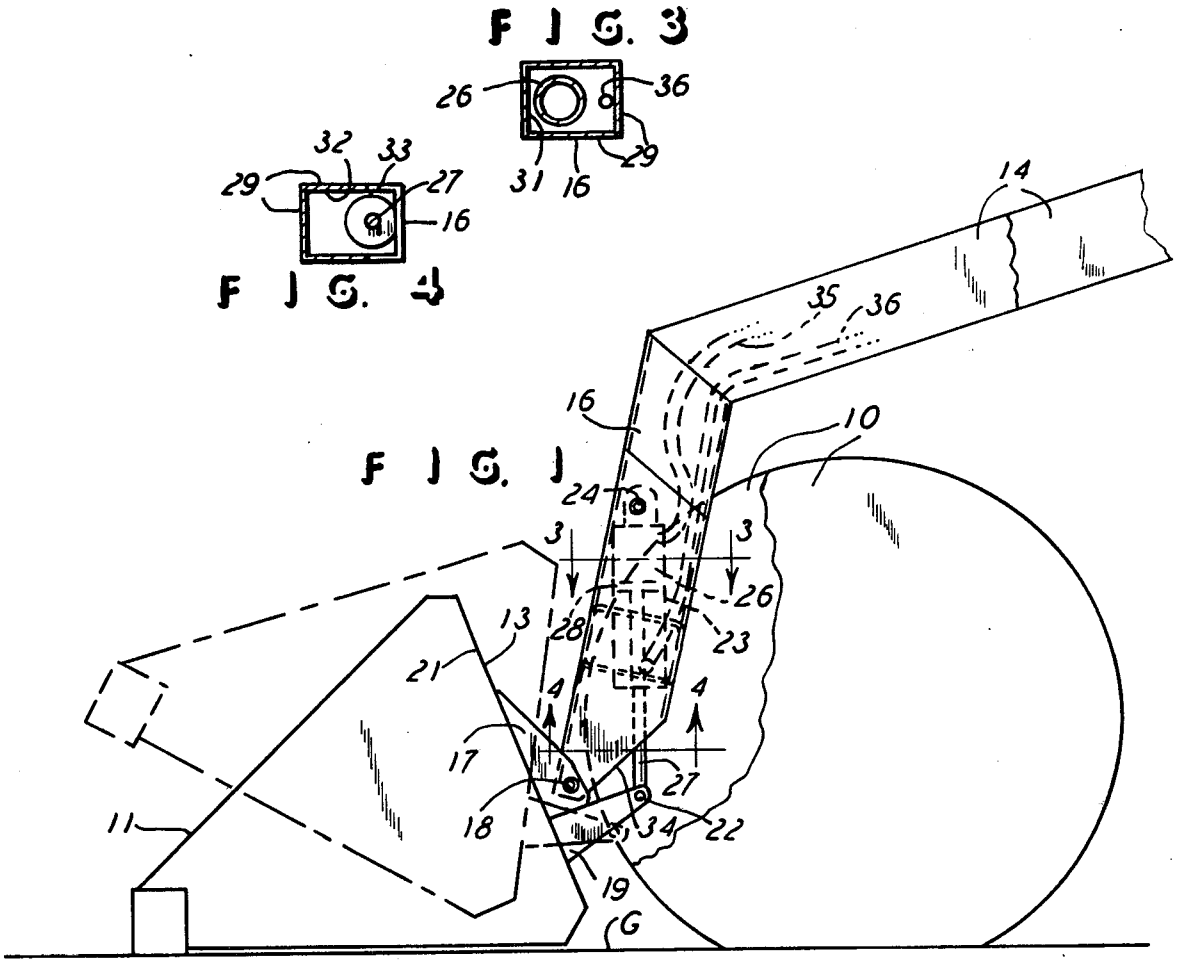
FIG. 1
FIG. 3
FIG. 4
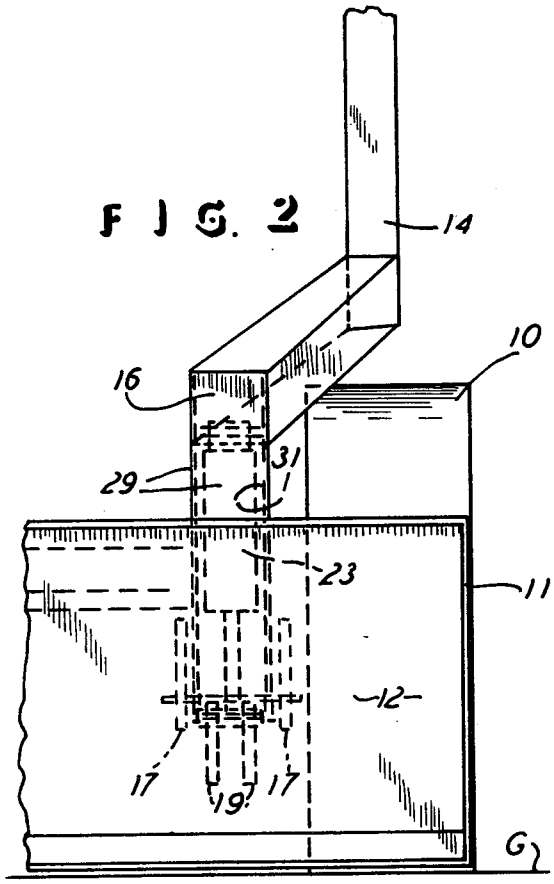
FIG. 2

REVERSE LINKAGE LOADER BUCKET ARM WITH ENCLOSED CYLINDER

This invention relates to a reverse linkage loader bucket arm with an enclosed cylinder assembly, all of which pertains to loaders for lifting material in a bucket and with the bucket being pivotally mounted on lift or loader arms.

BACKGROUND OF THE INVENTION

This particular invention has application to the so-called skid-steer loaders which are equipped with loader arms that pivotally attach to a loader bucket near the bottom of the bucket and there is a cylinder assembly pivotally connected between the arm and the bucket for pivoting the bucket in the loading and emptying of the bucket. A common arrangement of the prior art loaders is such that the location of the pivot point of the cylinder assembly and the bucket is at a higher elevation than the location of the pivot point between the arm and the bucket. With that arrangement, the cylinder assemblies are generally mounted between the loader arms or on top of the loader arms, and the break-out and rollback of the bucket is achieved with the rod ends of the cylinder assemblies. As such, the cylinder assemblies are exposed and are therefore subject to damage from being bumped and also from the material spilling over the back of the bucket onto the cylinder assemblies.

The prior art also has the so-called reverse linkage wherein the pivot connection between the bucket and the cylinder assembly is at an elevation lower than the location of the pivot connection between the arm and the bucket, at least when the bucket is in the normal horizontal loading position. Prior art examples of utilization of cylinder assemblies with loader buckets and the like are found in U.S. Pat. Nos. 3,239,083 and 3,251,490 and 3,554,396 and 3,610,450 and 3,612,311. These patents show loader buckets or the like with cylinder assemblies attached at points which are lower than the elevation of the attachment location between the bucket and the arm. However, the aforesaid patents all reveal that the cylinder assembly is exposed at a location directly rearwardly of the bucket or the like, and thus it is subject to being damaged and to having the loading material fall onto the cylinder assembly.

Accordingly, the present invention utilizes an arrangement wherein the cylinder assembly is enclosed and thus is protected from damage and from material which spills over the back of the bucket, and this is accomplished by providing a hollow loader or lift arm and placing the cylinder assembly within the hollow arm. The prior art is aware of some arrangement for somewhat nesting a cylinder assembly in loader buckets or like implements, and that partial nesting is shown in U.S. Pat. Nos. 2,645,368 and 3,042,233 and 3,061,123 and 3,184,085 and 3,666,124 and 3,695,467 and 3,698,580 and 4,015,728. Thus, these patents show cylinder assemblies used with loader buckets or the like and with the assembly being somewhat concealed by or partially nested within the lift arm or the like. However, these patents do not show a loader or lift arm which is completely enclosed around its transverse girth and has a hollow interior extending along the axis thereof and terminating in an open end adjacent the bucket or the like.

The present invention combines the use of the reverse linkage and the enclosed cylinder assembly and presents several important and basic advantages. One advantage is that the cylinder assembly is pressurized at its head end during the break-out and rollback actions, and this increases the force applied during these actions and by a given capacity cylinder assembly. Additionally, the cylinder assembly is enclosed and is not subject to damage by being bumped or by material spilling thereon from the bucket. Still further, the enclosed cylinder assemblies are thus out of the way and do not protrude to obscure the operator vision of the work area or to obstruct the entry to the tractor, and they are out of the way and therefore provide for greater maneuverability of the loader arms. Still further, with the reverse linkage and the enclosed cylinder assemblies, the overall length of the machine can be reduced, and also the degree of articulation of the bucket on the arms is an optimum, and the bucket can be maneuvered in maximum scooping action to provide for a self-filling function of the bucket. Further, since the head end of the cylinder is pressurized during bucket loading, the loading action is not only more forcefully accomplished but it is more slowly and accurately accomplished with greater control, and, conversely, during dumping of the bucket, the reverse linkage arrangement provides for a more rapid dump action, and that rapid action will help to shake material from the bucket as well as increase productivity.

In summary, the present invention provides for an assembly of a loader arm and a bucket and a cylinder assembly all of which constitutes a reverse linkage connection and with the cylinder assembly concealed within the hollow loader arm and with it arranged so that maximum force can be applied by the cylinder assembly in the loading of the bucket and maximum speed in the dumping action can be achieved. In this accomplishment, the cylinder assembly is protected from damage and debris and it is out of the way both for maneuverability of the arms and for the operators's view of the work area and for access to other parts of the machine, and yet the assembly is connected directly to the bucket and no intervening linkages are required.

Other objects and advantages will become apparent upon reading the following description in light of the accompanying drawings.

BRIEF DESCRIPTION OF THE DRAWINGS

FIG. 1 is a side elevational view of a front portion of a tractor having the structure of this invention shown thereon.

FIG. 2 is a front elevational view of FIG. 1.

FIGS. 3 and 4 are sectional views taken respectively on the lines 3—3 and 4—4 of FIG. 1.

DETAILED DESCRIPTION OF THE PREFERRED EMBODIMENT

The machine of this invention is shown to be of the loader type and includes a vehicle or tractor having front wheels 10 supported on a ground line designated G. A loader bucket 11 is disposed forward of the machine and has an open front end 12 and a rear portion 13 which is faced toward the remainder of the tractor, and that is in a conventional arrangement for a loader. The tractor also has loader or lift arms 14 which extend from a central point on the tractor and are pivotal thereon, but they are not shown herein since it will be understood by one skilled in the art and the arrangement is at least generally like that shown in the aforesaid patents. Thus, the drawings show the loader arms 14 and they extend forwardly along the left and right sides of the tractor and extend to a terminal end 16 which is directed downwardly, as shown in FIG. 1 and when the bucket 11 is in the so-called horizontal scooping position which is that position shown in FIG. 1 and in FIG. 2. FIG. 2 shows the left loader arm 14, and it will be understood that there would be another loader arm 14 on the right of the tractor, as indicated in FIG. 1.

The bucket 11 is pivotally mounted on the loader arm 14 by means of two spaced-apart ears 17 affixed as a part of the bucket rear portion 13 and supporting a pivot pin 18 between each two ears 17 and connecting with the loader arm lower end, as shown. Thus the bucket 11 is free to pivot about the pin 18 in both the clockwise and counterclockwise position from that shown in FIG. 1, and the dot-dash position shows the bucket pivoted clockwise to a loaded and lifting position in FIG. 1.

The bucket rear portion 13 also has additional ears 19 which extend rearwardly of the bucket rear wall 21, and two ears 19 are spaced apart and support a pivot pin 22 which is at a location lower than the pin 18 in the horizontal or FIG. 1 position for the bucket 11. That arrangement provides for the reverse linkage connection in that the pin 22 is lower than the pin 18 and is also further rearward from the pin 18 relative to the bucket rear wall 21.

A fluid cylinder assembly 23 is pivotally connected with the pin 22 and is pivotally connected with the loader arm 14 through a pivot pin 24. Thus the assembly 23 is generally vertically disposed with its longitudinal axis being vertical, and the assembly 23 is thus directly connected to the bucket rear portion 13 without any intervening articulated links or the like between the assembly 23 and the bucket 11. The assembly 23 has a cylinder portion 26 and a rod 27 which extends from the cylinder 26 and which has the usual piston 28. Thus, the connection location established by the pin 22 will move in an arc about the pivot connection location 18 when the cylinder assembly 23 is extended and retracted.

The boom arm terminal end or portion 16 is hollow along its longitudinal axis or direction and is formed by a completely enclosed arrangement of the four side walls designated 29 which form an endless girth transverse to the longitudinal axis of the extending terminal end 16. Thus, the terminal end 16 presents a hollow interior designated 31, and the cylinder assembly 23 is disposed with the hollow interior 31, as shown. Of course the lower end of the assembly rod 27 extends beyond the boom arm terminal end 16 by passing through an opening 32 in the terminal end lower end. A lower edge 33 of the terminal end 16 extends endlessly around the opening 32, as the side walls 29 also extend around the hollow interior of the terminal end 16. FIGS. 3 and 4 show the relationship between the boom arm 14 and the cylinder assembly 23 and the enclosure of the latter by means of the hollow terminal end 16, as described herein.

Also, fluid lines or hoses 35 and 36 extend in the hollow interior of the terminal end 16 and are suitably connected to the cylinder assembly 23 for the passage of fluid to and from the head end and the rod end of the cylinder 26, in the normal manner. Thus, the cylinder head end can be energized by introducing fluid under pressure, and that will cause the bucket 11 to dig and lift and thus the most forceful action is applied with the assembly 23 arranged as described. Likewise, when the bucket 11 is being emptied, the fluid can be fully and readily evacuated from the head end while the rod end is pressurized and thus the bucket 11 can be rapidly emptied.

The arrangement is such that the reverse linkage is accomplished and the cylinder assembly 23 is enclosed by the loader or boom arm terminal end 16 which is hollow for protecting and concealing the assembly 23 and thus rendering the entire arrangement efficient and forceful and compact. Also, the ears 19 are shown to be spaced together a distance no greater than the width of the terminal end 16, as viewed in FIG. 2, and thus the ears can partly enter the hollow terminal end 16 when the bucket 11 is pivoted in a counterclockwise direction from that shown in FIG. 1, and also the terminal end 16 has an undercut or angulated edge 34 which is directed to face away from the bucket 11 and thus permit maximum pivot of the bucket 11 toward the boom arm terminal end 16 in the counterclockwise direction mentioned. In the entire arrangement, the reverse linkage is utilized and the most efficient and forceful and protected arrangement for the cylinder assembly 23 is also accomplished. Thus, through the combination of the so-called reverse linkage connection and the enclosing of the assembly 23 within the boom arm, the aforesaid advantages are accomplished.

What is claimed is:

1. A reverse linkage loader bucket arm with an enclosed cylinder, comprising a loader bucket having an open front and a closed rear portion in a horizontal orientation for being loaded, an arm extending to a terminal end adjacent said loader bucket rear portion, said bucket being pivotally mounted on said arm terminal end at a location on said rear portion, said arm being axially hollow along said terminal end and being of an endless girth transverse to the axis thereof and terminating in an open end, said arm open end being defined by an edge of said arm surrounding said open end at said terminal end and defining said open end, said edge lying on a plane oblique to the longitudinal axis of said terminal end, for accommodating the pivotal movement of said bucket on said arm, and a cylinder assembly disposed within said hollow terminal end and being pivotally connected to said arm and to said bucket rear portion at a location spaced at an elevation lower than the location of the pivot connection between said bucket and said arm.

2. The reverse linkage loader bucket arm with an enclosed cylinder as claimed in claim 1, wherein said cylinder asssembly has a head end and a rod end, and said head end is connected to said arm and said rod end is connected to said bucket, for maximum force of said assembly on said bucket in the pivoting of said bucket upwardly and toward said arm for loading said bucket.

3. The reverse linkage loader bucket arm with an enclosed cylinder as claimed in claim 1, including pivot attachment ears on said bucket rear portion and extending rearwardly thereon and being vertically spaced apart, said cylinder assembly being pivotally connected with the lower of said ears, and said arm being pivotally connected with the upper of said ears.

4. The reverse linkage loader bucket arm with an enclosed cylinder as claimed in claim 1, including fluid hoses extending within said hollow arm and connected with said cylinder assembly for flow of fluid to and from said cylinder assembly.

* * * * *